US007232011B2

(12) United States Patent
Strebel et al.

(10) Patent No.: US 7,232,011 B2
(45) Date of Patent: Jun. 19, 2007

(54) EQUIPMENT FOR FINE POSITIONING OF THE CARS OF A MULTI-STAGE CAR FOR AN ELEVATOR

(75) Inventors: René Strebel, Merenschwand (CH); René Hoffmann, Steinhausen (CH); Urs Schaffhauser, Root (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 11/080,034

(22) Filed: Mar. 15, 2005

(65) Prior Publication Data

US 2006/0163006 A1 Jul. 27, 2006

(30) Foreign Application Priority Data

Mar. 17, 2004 (EP) ..... 04006288

(51) Int. Cl.
*B66B 9/00* (2006.01)

(52) U.S. Cl. ..... 187/249; 187/291; 187/251; 254/265; 254/385

(58) Field of Classification Search ..... 187/249, 187/251, 401, 404, 406, 414, 291; 254/265, 254/385, 128; 74/37, 89.2; 49/120; *B66B 1/06, B66B 9/00, 11/02*

See application file for complete search history.

(56) References Cited

U.S. PATENT DOCUMENTS

| | | | | |
|---|---|---|---|---|
| 1,896,776 | A * | 2/1933 | James | 187/249 |
| 6,161,652 | A * | 12/2000 | Kostka et al. | 187/291 |

FOREIGN PATENT DOCUMENTS

| | | | |
|---|---|---|---|
| EP | 1 357 075 | | 10/2003 |
| JP | 48 076242 | | 10/1973 |
| JP | 48076242 B | * | 10/1973 |
| JP | 2000296971 | | 10/2000 |
| WO | WO02/38342 | | 5/2002 |
| WO | WO03/086932 | | 10/2003 |
| WO | WO2004/087552 | | 10/2004 |

* cited by examiner

*Primary Examiner*—Gene O. Crawford
*Assistant Examiner*—Stefan B. Kruer
(74) *Attorney, Agent, or Firm*—Fraser Clemens Martin & Miller LLC; William J. Clemens

(57) ABSTRACT

A multi-stage elevator car has equipment for fine positioning of the cars wherein the car thresholds are positionable at the level of the floor thresholds. Adjusting equipment operating on the principle of a differential block and pulley is provided for fine positioning of the cars, the equipment including an endless cable guided over deflecting rollers arranged at the main frame of the multi-stage car and over deflecting rollers arranged at the cars, wherein the cars execute vertical movements of opposite sense.

12 Claims, 3 Drawing Sheets

EQUIPMENT FOR FINE POSITIONING OF THE CARS OF A MULTI-STAGE CAR FOR AN ELEVATOR

BACKGROUND OF THE INVENTION

The present invention relates to equipment for fine positioning of the cars of a multi-stage car for an elevator, wherein the car thresholds of the cars are positionable at the level of the floor thresholds.

An elevator with a double-deck car is shown in the Japanese patent document JP 2000296971, in which the upper car can be matched to the upper edge of the floor to be served and the lower car can be matched to the upper edge of the floor to be served. Deflecting rollers are arranged at the upper yoke of the main frame, which carries the cars, on each side and are drivable by means of a drive arranged at the upper yoke. A cable, which is connected at one end with the upper car and at the other end with the lower car, is guided over each deflecting roller, wherein the cars are moved in opposite sense to the positioning at the floor level.

A disadvantage of this known equipment resides in the fact that the cables are guided at each side over driven deflecting rollers. Due to slip or inaccuracies on the driven deflecting rollers, the car can tilt in the guides.

SUMMARY OF THE INVENTION

The present invention meets the object of avoiding the disadvantages of the known equipment and of creating a multi-stage car with cars able to be matched to the floors in terms of level, whereby safe boarding and departure for the elevator passengers is guaranteed.

The advantages achieved by the present invention are that with the multi-stage car according to the present invention the performance capability of the multi-stage elevator can be improved, because fine positioning of the stage or stages can be carried out in a shorter time. In addition, it is advantageous that a constant torque is required over the entire range of adjustment, wherein the range of adjustment is freely selectable by means of the cable length. Drive of the elevator cars is based on the principle of the differential block and tackle, which operates with a large translation, which together with the overall low friction losses creates the possibility of using a gearless drive for level matching of the cars. Moreover, the cars cannot tilt in the guides, because the selected cable guide cannot work against the car guides.

It is further of advantage that a proven and readily manageable technology can be used, which is distinguished by low friction losses, high rates of adjustment and rapid level matching, wherein matchings are possible during travel or at standstill. The elevator cars mutually form weight compensation, wherein in normal operation the forces do not extend beyond the side panels. A main frame is not absolutely necessary. An upper yoke, which is guided directly at the guide rails, is sufficient. Car frames are not necessary in the case of self-supporting elevator cars or open cars. Main yoke and cars can be guided directly at the guide rails.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
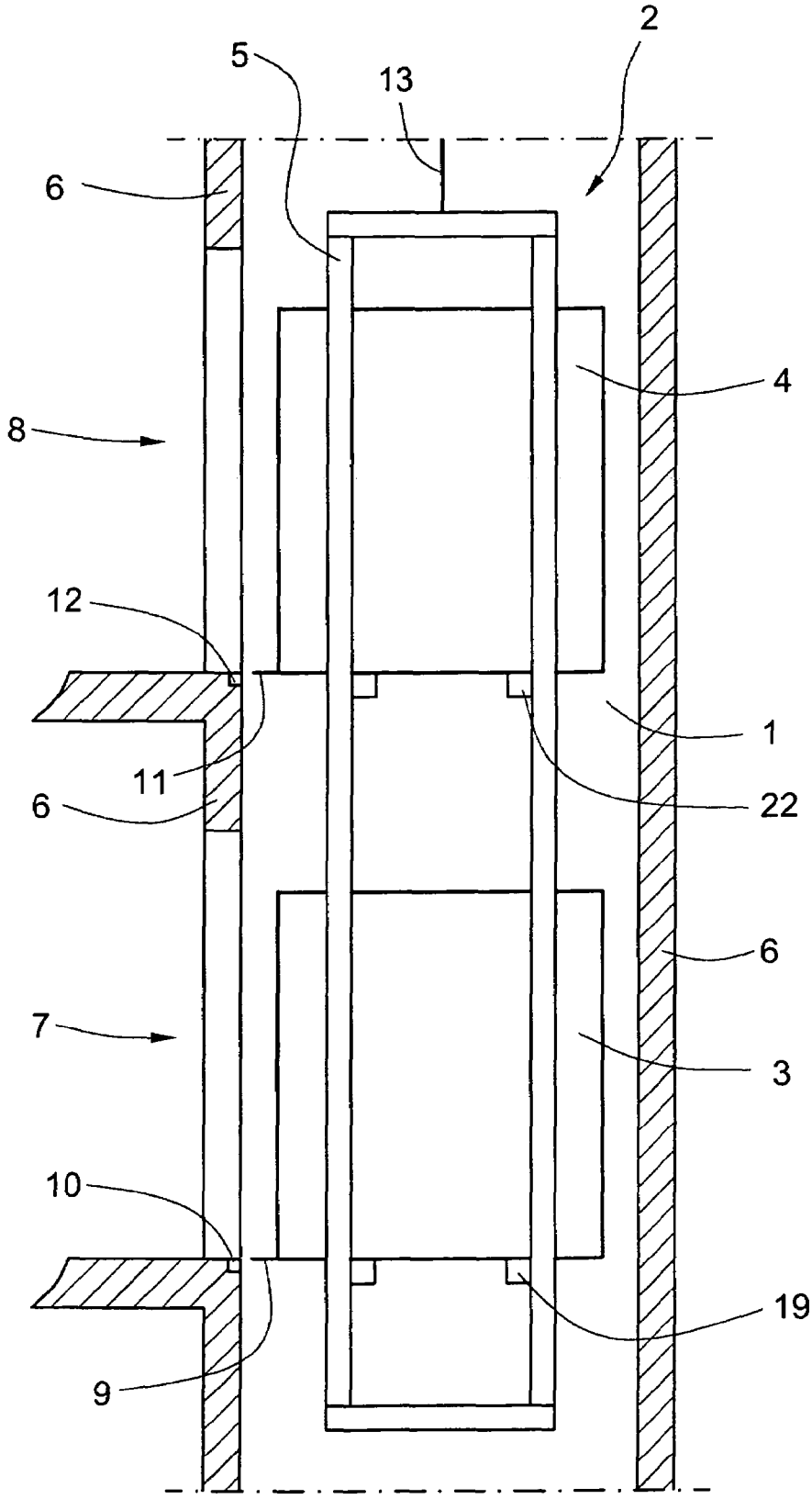
FIG. 1 is a schematic cross-sectional elevation view of a multi-stage car which is movable in an elevator shaft and consists of a lower car and an upper car according to the present invention.

FIG. 1 shows a multi-stage car 2 movable in an elevator shaft 1 and consisting of a lower car 3 and an upper car 4, which are arranged in a main frame 5. The elevator shaft 1 is formed from shaft walls 6, wherein an opening which serves for access to the multi-stage car 2 and which is closed by a floor door (not illustrated) is provided for each floor. The openings of the elevator cars 3, 4 are closed by car doors (not illustrated). An uneven-numbered floor is denoted by 7 and an even-numbered floor is denoted by 8. The lower car 3 stands at the uneven-numbered floor 7 and the upper car 4 stands at the even-numbered floor 8. After positioning of the lower car 3 a car threshold 9 is flush in terms of level with a floor threshold 10. After positioning of the upper car 4 a car threshold 11 is flush in terms of level with a floor threshold 12. The drive for the multi-stage car 2, wherein supporting and driving means, for example cables 13, are guided over a drive pulley is not illustrated. A counterweight (not illustrated) is provided as weight compensation for the multi-stage car 2.

Figure 2:
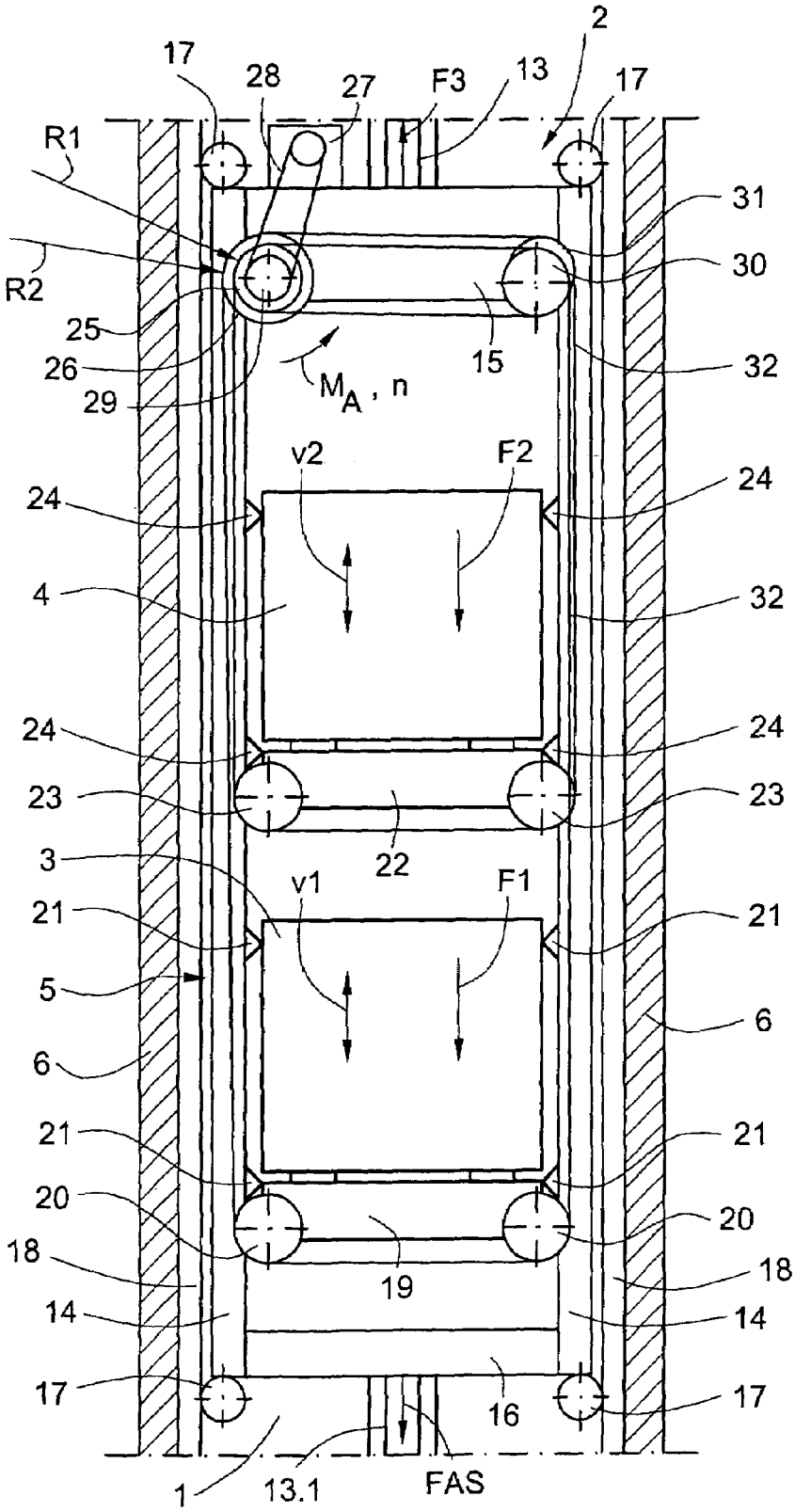
FIG. 2 is a view similar to FIG. 1 showing the multi-stage car with the adjusting equipment according to the present invention for the cars.

FIG. 2 shows the multi-stage car 2 with the adjusting equipment according to the present invention for the cars 3, 4. The main frame 5 consisting of side panels 14, an upper yoke 15 and a lower yoke 16 is guided by means of guide shoes 17 along guide rails 18 arranged in the elevator shaft 1 and is carried by the cables 13. Compensating cables are denoted by 13.1. The lower car 3 is mounted to be standing on a car frame 19, at which two free-running deflecting rollers 20, so-termed lower blocks, are arranged. The car 3 and the car frame 19 are guided by means of guides at the side panels 14 and hang in the support means. The upper car 4 is mounted to be standing on a car frame,22 at which two free-running deflecting rollers 23, so-termed lower blocks, are arranged. The car 4 and the car frame 22 are guided by means of guides 24 at the side panels 14 and hang at the support means.

A deflecting roller 25 arranged at the upper yoke 15 and with a radius R1 or diameter D1 is fixedly connected with a deflecting roller 26 with a radius R2 or a diameter D2. The deflecting rollers 25, 26 are drivable, for example, by means of a drive 27 arranged at the upper yoke 15, wherein a belt 28 acts on a belt pulley 29 connected with the deflecting rollers 25, 26 and generates a torque $M_A$ at a rotational speed n. The drive can be with or without gearing. Moreover, two deflecting rollers 30, 31 free-running independently of one another are arranged at the upper yoke 15.

At least one of the other deflecting rollers 20, 23, 30, 31 can also be drivable instead of the rollers 25, 26.

The deflecting rollers 20, 23, 25, 26, 30, 31 are connected by way of a support means, for example a cable 32 or several cables guided in parallel. A belt can also be provided instead of the cable. The cable 32 is endless and has the following course: deflecting roller 25—deflecting roller 30—deflecting rollers 20—deflecting roller 26—deflecting roller 31—deflecting rollers 23—deflecting roller 25. The cars 3, 4 execute vertical movements of opposite sense. For increase in traction, the support means 23 can be multiply looped on the rollers 25, 26, 30, 31.

Figure 3:
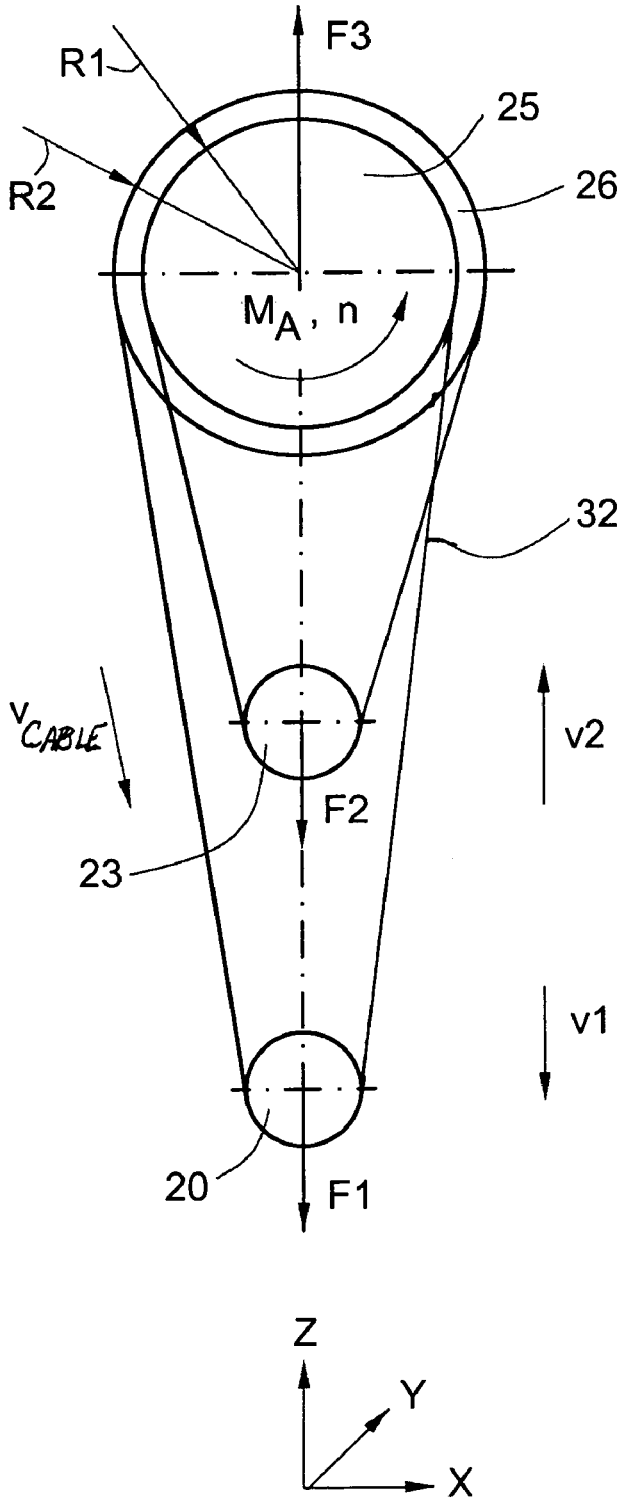
FIG. 3 is a schematic diagram of the principle of operation of the adjusting equipment according to the present invention.

FIG. 3 shows the adjusting equipment, which operates on the principle of a differential block and tackle, for the cars 3, 4. The deflecting rollers 25, 26 are variable in diameter independently of the belt pulley 29, wherein the belt pulley 29 can, for example, be of approximately the same size and diameter as the deflecting roller 25.

The speeds "v", the forces "F" and the moment $M_A$ can be mathematically calculated as follows:

$$v_{cable}=(n\cdot\pi\cdot D1) \text{ or } (n\cdot\pi\cdot D2) \quad [1]$$

$$v1=(n\cdot\pi\cdot D1)-(n\cdot\pi\cdot D2) \quad [2]$$

$$v2=(n\cdot\pi\cdot D2)-(n\cdot\pi\cdot D1) \quad [3]$$

$$\Delta v=v1-v2=2\cdot n\cdot\pi\cdot(D1-D2) \quad [4]$$

$$F3=F1+F2+GFK+FAS \quad [5]$$

$$\Delta F=F1-F2 \quad [6]$$

$$M_A=(R1-R2)\cdot\Delta F\cdot\tfrac{1}{2} \quad [7]$$

Wherein:

D1: diameter of deflecting roller 25

D2: diameter of deflecting roller 26

R1: radius of deflecting roller 25

R2: radius of deflecting roller 26

$v_{cable}$: cable speed v1: speed of lower car 3 v2: speed of upper car 4

F1: total weight force of the lower car 3

F2: total weight force of the upper car 4

F3: force in the cables 13 (total weight of the multi-stage car 2)

GFK: weight force of main frame 5

$M_A$: torque necessary at the deflecting rollers 25, 26 n: rotational speed of the deflecting rollers 25, 26

FAS: force in the compensating cables 13.1

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An equipment for fine positioning of cars of a multi-stage car for an elevator wherein car thresholds of the cars are positionable at a level of floor thresholds comprising: adjusting equipment formed as a differential block and tackle and attached to the cars for fine positioning of the cars relative to the floor thresholds, said differential block and tackle including different diameter deflecting rollers fixedly interconnected and being drivable, and including a support means for the cars, wherein said support means is guided over each of said different diameters deflecting rollers.

2. The equipment according to claim 1 wherein said adjusting equipment includes one of an endless cable and an endless belt being said support means and guided over deflecting rollers arranged at a main frame of the multi-stage car and guided over deflecting rollers arranged at the cars, and wherein the cars execute vertical movements of opposite sense upon actuation of said adjusting equipment.

3. The equipment according to claim 2 wherein said deflecting rollers arranged at the main frame include said different diameter deflecting rollers arranged at an upper yoke of the main frame.

4. The equipment according to claim 3 wherein said one of an endless cable and an endless belt engages one of said different diameter deflecting rollers with a first diameter, is guided at a first of said deflecting rollers ranged at the main frame, then over ones of said deflecting rollers arranged at a lower one of the cars, then over another one of said different diameter deflecting rollers with a second diameter, then over a second of said deflecting rollers ranged at the main frame, then over ones of said deflecting rollers arranged at an upper one of the cars and back to said deflecting roller with the first diameter , the first diameter being different than the second diameter.

5. An equipment for fine positioning of cars of a multi-stage car for an elevator comprising:

a pair of cars movably mounted in a main frame; and adjusting equipment formed as a differential block and tackle attached to said ears for fine positioning of thresholds of said ears at a level of floor thresholds, said adjusting equipment being attached to said cars and said main frame, said frame adjusting equipment including frame deflecting rollers having different diameters and being fixedly interconnected and drivable, and including a support means for said cars, wherein said support means is guided over each of said deflecting rollers having different diameters.

6. The equipment according to claim 5 wherein said adjusting equipment includes an endless flexible drive means as said support means, wherein said support means is guided over said frame deflecting rollers mounted at said main frame and guided over car deflecting rollers attached to said cars, and wherein said cars execute vertical movements of opposite sense upon actuation of said adjusting equipment.

7. The equipment according to claim 6 wherein said frame deflecting rollers are arranged at an upper yoke of said main frame.

8. The equipment according to claim 6 wherein said drive means engages a first of said frame deflecting rollers with a first diameter, is guided a second of said frame deflecting rollers, then over ones of said car deflecting rollers arranged at a lower one of said cars, then over a third of said frame deflecting rollers with a second diameter different than the first diameter, then over a fourth of said frame deflecting rollers, then over ones of said ear deflecting rollers arranged at an upper one of said cars and back to said frame deflecting roller with the first diameter.

9. The equipment according to claim 6 wherein said endless flexible drive means is one of a cable and a belt.

10. An equipment for fine positioning of cars of a multi-stage car for an elevator wherein car thresholds of the cars are positionable at a level of floor thresholds comprising: adjusting equipment formed as a differential block and tackle and attached to the cars for fine positioning of the cars relative to the floor thresholds, said adjusting equipment including one of an endless cable and an endless belt guided over deflecting rollers arranged at a main frame of the multi-stage car and guided over deflecting rollers arranged at the cars, and wherein the cars execute vertical movements of opposite sense upon actuation of said adjusting equipment.

11. The equipment according to claim 10 wherein said deflecting rollers arranged at the main frame include different diameter deflecting rollers arranged at an upper yoke of the main frame, and wherein said different diameter deflecting rollers are fixedly interconnected and are drivable.

12. The equipment according to claim 10 wherein said one of an endless cable and an endless belt engages one of said different diameter deflecting rollers with a first diameter, is guided at a first of said deflecting rollers arranged at the main frame, then over ones of said deflecting rollers arranged at a lower one of the cars, then over another one of said different diameter deflecting rollers with a second diameter, then over a second of said deflecting rollers arranged at the main frame, then over ones of said deflecting rollers arranged at an upper one of the cars and back to said deflecting roller with the first diameter, the first diameter being different than the second diameter.

* * * * *